US006476837B2

(12) United States Patent
Ogata

(10) Patent No.: US 6,476,837 B2
(45) **Date of Patent: *Nov. 5, 2002**

(54) DEVELOPER REMAINING AMOUNT DETECTING APPARATUS AND DEVELOPER REMAINING AMOUNT DETECTING METHOD

(75) Inventor: Hiroaki Ogata, Shizuoka-ken (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/447,712

(22) Filed: Nov. 23, 1999

(65) Prior Publication Data

US 2001/0043259 A1 Nov. 22, 2001

(30) Foreign Application Priority Data

Nov. 27, 1998 (JP) ..... 10-353904

(51) Int. Cl.[7] ..... B41J 2/385; G03G 13/04; G03G 15/08

(52) U.S. Cl. ..... 347/140; 399/27

(58) Field of Search ..... 347/140; 399/27, 399/30, 24, 53, 58, 60

(56) References Cited

U.S. PATENT DOCUMENTS

| | | | | |
|---|---|---|---|---|
| 5,160,966 A | * | 11/1992 | Shiina et al. | 399/27 |
| 5,202,769 A | * | 4/1993 | Suzuki | 399/58 X |
| 5,204,698 A | * | 4/1993 | LeSueur et al. | 347/140 |
| 5,530,527 A | * | 6/1996 | Fukasawa et al. | 347/140 X |
| 5,724,627 A | * | 3/1998 | Okuno et al. | 399/27 |
| 5,794,094 A | * | 8/1998 | Boockholdt et al. | 399/27 |
| 5,937,225 A | * | 8/1999 | Samuels | 399/27 |

* cited by examiner

*Primary Examiner*—Sandra Brase
(74) *Attorney, Agent, or Firm*—Fitzpatrick, Cella, Harper & Scinto

(57) ABSTRACT

A developer remaining amount detecting apparatus of a developing apparatus for developing an electrostatic image on an image bearing body, includes a counter means for counting a number of an image data, an integrator means for integrating a using amount on the image bearing body, and operating section for operating a developer remaining amount on the basis of a count value of the counter and an integrated value of said integrator.

9 Claims, 7 Drawing Sheets

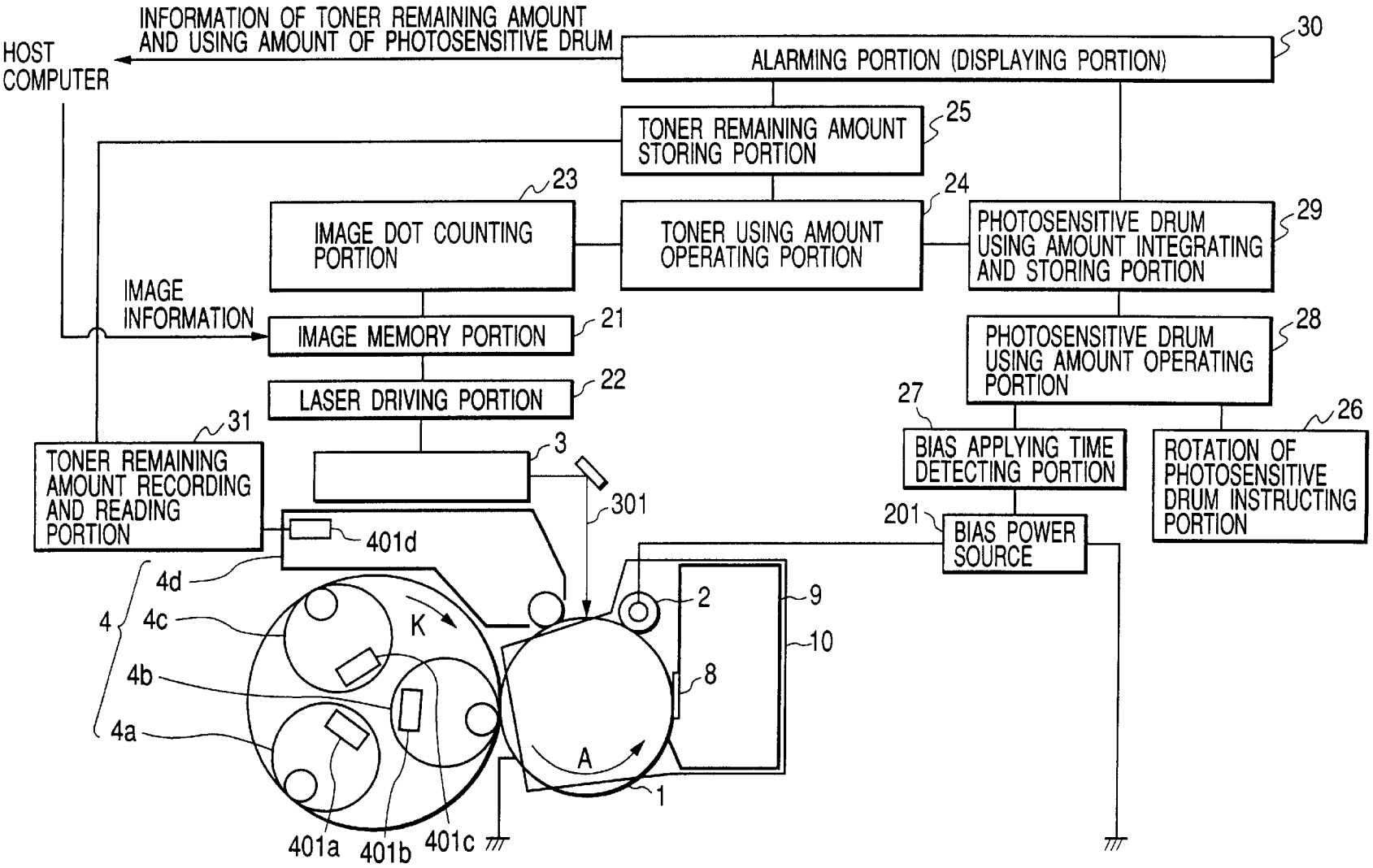
FIG. 5
ALARMING PORTION (DISPLAYING PORTION)
30
TONER REMAINING AMOUNT STORING PORTION
25
TONER USING AMOUNT OPERATING PORTION
24
PHOTOSENSITIVE DRUM USING AMOUNT INTEGRATING AND STORING PORTION
29
PHOTOSENSITIVE DRUM USING AMOUNT OPERATING PORTION
28
ROTATION OF PHOTOSENSITIVE DRUM INSTRUCTING PORTION
26
BIAS APPLYING TIME DETECTING PORTION
27
BIAS POWER SOURCE
201
IMAGE DOT COUNTING PORTION
23
IMAGE MEMORY PORTION
21
LASER DRIVING PORTION
22
3
301
TONER REMAINING AMOUNT RECORDING AND READING PORTION
31
INFORMATION OF TONER REMAINING AMOUNT AND USING AMOUNT OF PHOTOSENSITIVE DRUM
IMAGE INFORMATION
HOST COMPUTER
9
10
2
8
1
A
K
401d
401c
401b
401a
4d
4c
4b
4a
4

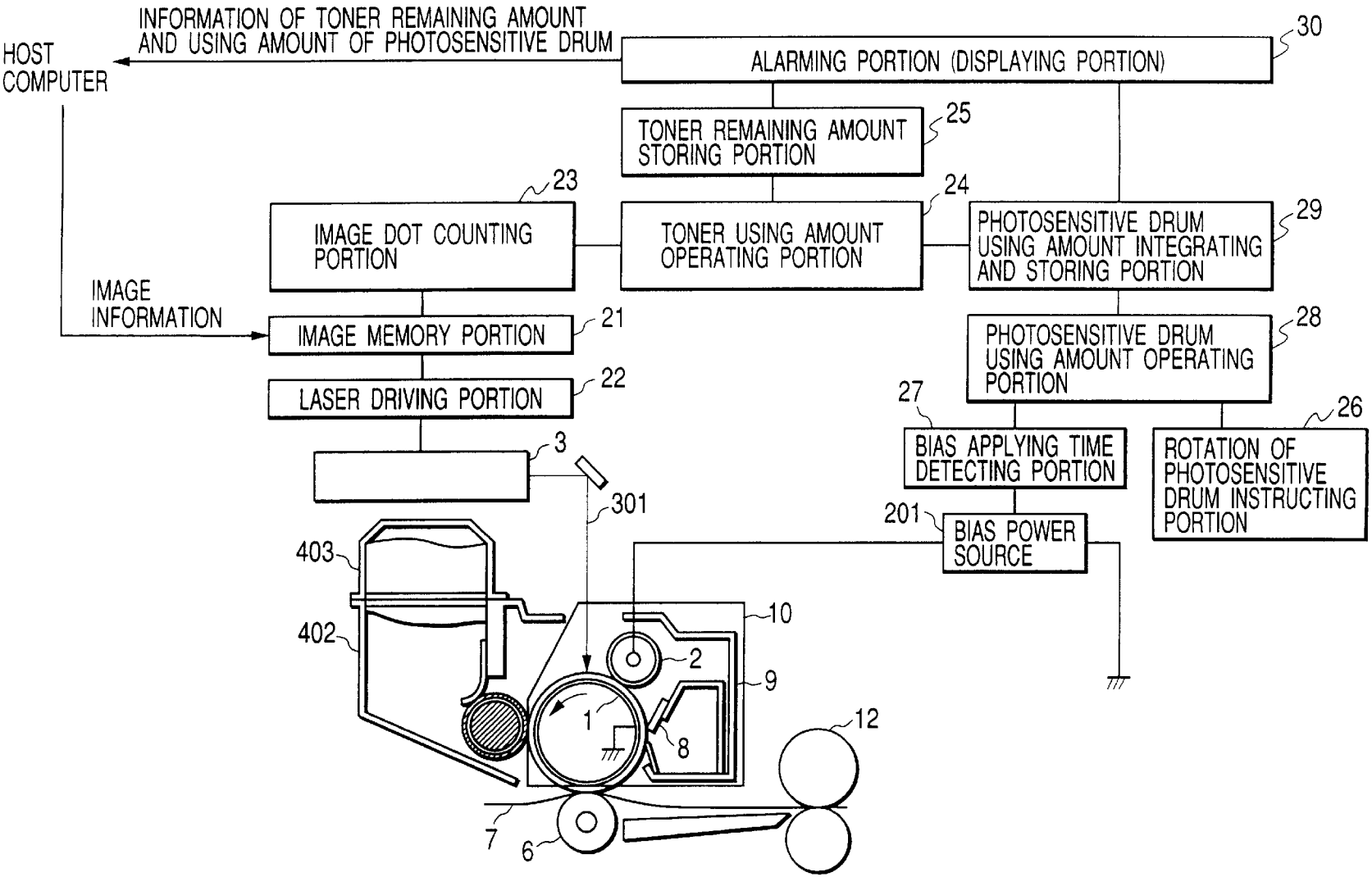
FIG. 6
ALARMING PORTION (DISPLAYING PORTION)
30
TONER REMAINING AMOUNT STORING PORTION
25
TONER USING AMOUNT OPERATING PORTION
24
PHOTOSENSITIVE DRUM USING AMOUNT INTEGRATING AND STORING PORTION
29
PHOTOSENSITIVE DRUM USING AMOUNT OPERATING PORTION
28
ROTATION OF PHOTOSENSITIVE DRUM INSTRUCTING PORTION
26
BIAS APPLYING TIME DETECTING PORTION
27
BIAS POWER SOURCE
201
IMAGE DOT COUNTING PORTION
23
IMAGE MEMORY PORTION
21
LASER DRIVING PORTION
22
3
301
INFORMATION OF TONER REMAINING AMOUNT AND USING AMOUNT OF PHOTOSENSITIVE DRUM
IMAGE INFORMATION
HOST COMPUTER
12
10
9
2
8
1
7
6
403
402

DEVELOPER REMAINING AMOUNT DETECTING APPARATUS AND DEVELOPER REMAINING AMOUNT DETECTING METHOD

BACKGROUND OF THE INVENTION

1. Field of the Invention

The present invention relates to apparatus and method for detecting a remaining amount of developer.

2. Related Background Art

In electrophotographic image forming apparatuses using an electrophotographic image forming process, the following methods have been used for detecting a remaining amount of developer in a developing device as developing means.

EXAMPLE 1

Antenna Remaining Amount Detecting System

This method is a system for detecting a remaining amount of developer on the basis of change in capacitance between a developer bearing body and a capacitance detecting member (antenna).

In this antenna remaining amount detecting system, since the change in amount of developer can be detected only in the vicinity of the developer bearing body, it is very effective to achieve a purpose for warning a no-developer condition in a developing chamber, but, a change in remaining amount of developer in the entire developing device including a developer hopper cannot be detected, with the result that intermediate developer decreasing conditions cannot be known.

EXAMPLE 2

Piezoelectric Remaining Amount Detecting System

This method is a system for detecting reduction of developer in a developer hopper by using a piezoelectric element arranged on a lower portion or the like of a side surface of the developer hopper.

In this piezoelectric remaining amount detecting system, a point at which the developer in the developer hopper is used up is merely detected, and it is very effective for controlling a timing for supplying developer into a developing chamber, but, a change in remaining amount of developer in the entire developing device cannot be detected, with the result that intermediate developer decreasing conditions cannot be known, as is in the antenna remaining amount detecting system.

EXAMPLE 3

Optical Remaining Amount Detecting System

This method is a system in which a light path for passing a laser beam is provided in a developer hopper or a developing chamber and presence/absence of developer is detected on the basis of presence/absence of a passed beam.

In this optical remaining amount detecting system, similar to the piezoelectric remaining amount detecting system, a point at which the developer in the developer hopper is used up is merely detected, and, a change in remaining amount of developer in the entire developing device cannot be detected, with the result that intermediate developer decreasing conditions cannot be known.

EXAMPLE 4

Image Dot Counting System

In the examples 1 to 3, while the developer was measured directly, in an example 4, the number of dots of an image formed on a photosensitive body (image bearing body) on which a latent image is to be formed, and the total developer using amount of the entire image is calculated by converting and calculating the number of image dots into a developer using amount, thereby detecting a remaining amount of developer.

In this image dot counting system, since the remaining amount of developer in the developing device can be known even during usage, the operator can know how many more prints are possible by successively indicating such remaining amount.

Conventionally, while the remaining amount of developer in the developing device was detected, in a recent market for electrophotographic equipments such as laser printers and copying machines, interest for improvement in usability has been increased. Regarding the detection of the remaining amount of developer, since it has been requested that not only warning be made immediately before the developer is used up, but also, at any stages, the operator be sequentially informed of the developer remaining amount to know how many more prints are possible, a function for sequentially announcing the remaining amount of developer has been realized, for example, by using the image dot counting system in the example 4.

On the other hand, while colorization and long endurance of laser printers and copying machines have been progressed, type of exchangeable process units has been changed from a developing device/photosensitive body integrated process unit for monocolor print to individually exchangeable photosensitive body unit and respective color (black, yellow, magenta, cyan) developing device units.

Since the service lives of the photosensitive body unit and the color developing device units differ from each other, such units were exchanged in accordance with respective service lives.

However, depending upon the using condition of the photosensitive body unit, even in the image patterns having the same image density, the developer using amount during the print is slightly changed.

As a result, when the developer remaining amount is detected by using the image dot counting system, the developer using amount of a developing device unit which is exchanged at an initial using stage of the photosensitive body unit differs from the developer using amount of a developing device unit which is exchanged at a last using stage of the photosensitive body unit, with the result that the operator cannot be informed of the actual developer using amount with high accuracy.

The reason is considered to be that, as the photosensitive body unit is continuously used, the thickness of the surface layer of the photosensitive body is decreased to increase the capacitance of the photosensitive layer and to make the surface of the photosensitive body more rough or to change the surface potential of the photosensitive body after exposure even when the same exposure amount is applied, with the result that the developing amount on the photosensitive body or the transferring amount from the photosensitive body to the transfer material or the intermediate transfer body is changed, thereby changing the developer using amount for obtaining the same image density.

SUMMARY OF THE INVENTION

An object of the present invention is to provide apparatus and method for detecting a developer remaining amount, in which a remaining amount of developer can be detected with high accuracy.

Another object of the present invention is to provide a developer remaining amount detecting apparatus comprising a dot counting portion for counting the number of dots in image data, which dots are to be developed by developer, the dot counting portion counting the number of dots to be developed in a predetermined unit among the entire image data, and a developer using amount calculating (operating) portion for operating or calculating a developer using amount for each of the predetermined units on the basis of the number of dots counted by the dot counting portion and for integrating calculated results with respect to an entire image, and a remaining amount of the developer is detected on the basis of the developer using amount integrated by the developer using amount calculating portion.

A further object of the present invention is to provide a developer remaining amount detecting method comprising the steps of counting the number of dots, in image data, to be developed in a predetermined unit among the entire image data, calculating a developer using amount for each of the predetermined units on the basis of the number of dots counted and integrating calculated results with respect to an entire image, and detecting a remaining amount of developer on the basis of the developer using amount integrated.

The other objects and features of the present invention will become more apparent upon consideration of the following description of the preferred embodiments of the present invention taken in conjunction with the accompanying drawings.

BRIEF DESCRIPTION OF THE DRAWINGS

FIG. 5 is a partial enlarged view showing a portion of an image forming apparatus according to alteration of the first embodiment and a block diagram therefor;

FIG. 6 is a partial enlarged view showing a portion of an image forming apparatus according to a second embodiment of the present invention and a block diagram therefor.

DESCRIPTION OF THE PREFERRED EMBODIMENTS

The present invention will now be explained in connection with embodiments thereof with reference to the accompanying drawings.

[First Embodiment]

Figure 1:
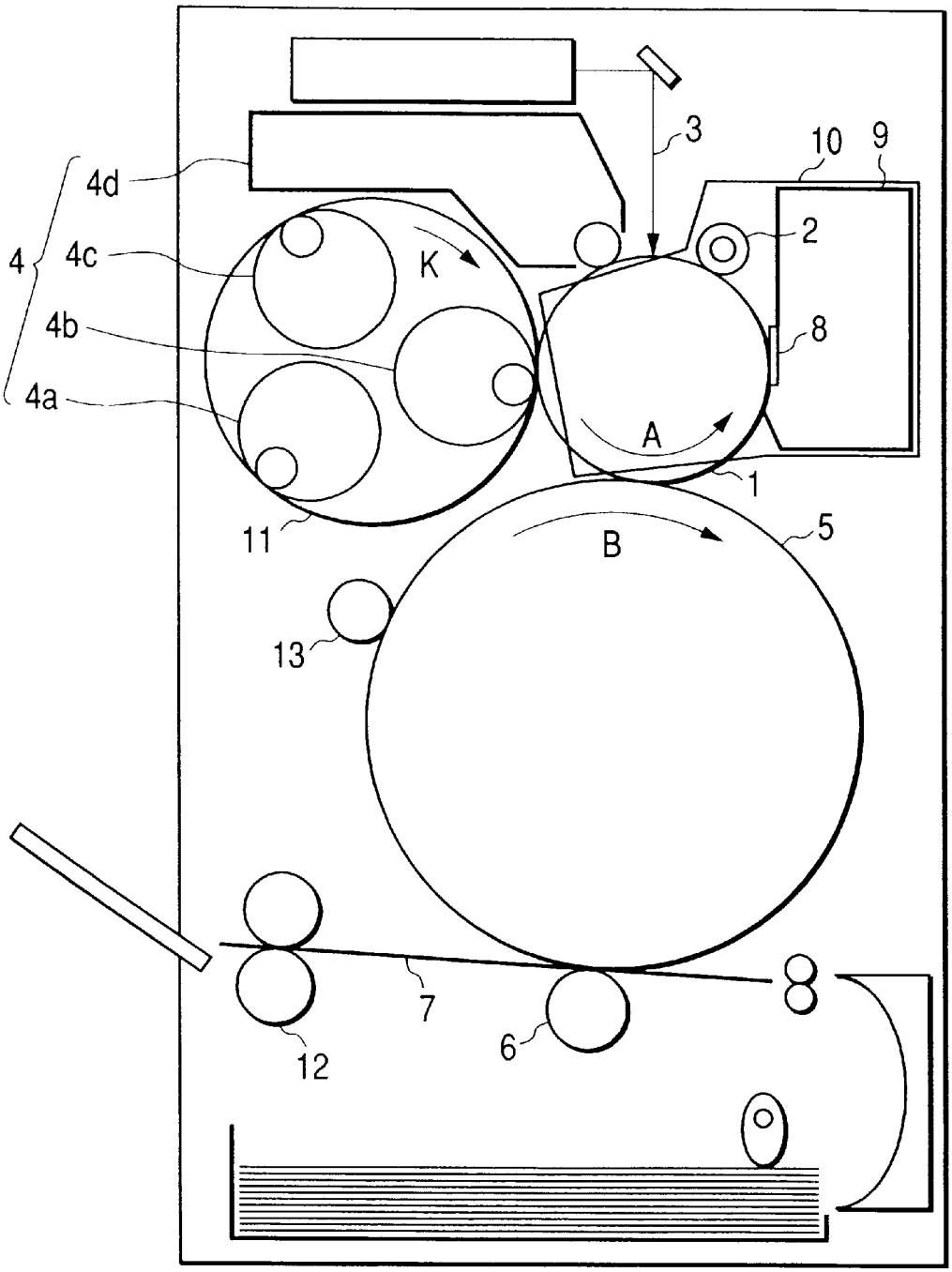
FIG. 1 is a schematic sectional view showing an image forming apparatus according to a first embodiment of the present invention.
Figure 2:
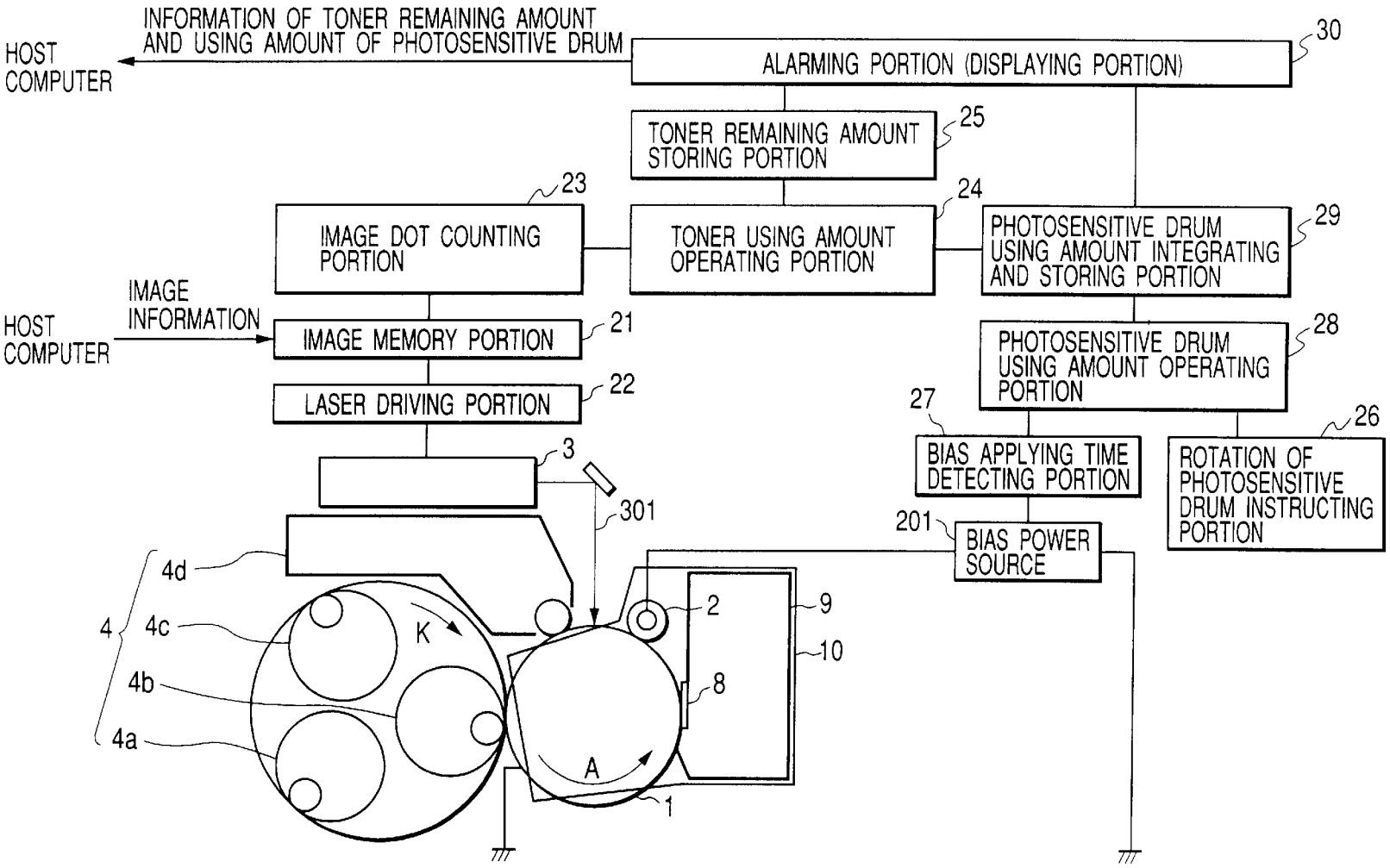
FIG. 2 is a partial enlarged view showing a portion of the image forming apparatus according to the first embodiment and a block diagram therefor.

FIG. 1 is a schematic sectional view of a laser printer as an image forming apparatus according to a first embodiment of the present invention, and FIG. 2 is a partial enlarged view showing a portion of the laser printer.

The laser printer according to the illustrated embodiment is connected to a host (not shown) such as a personal computer or a work station so that the laser printer can receive image data or image information from the host through a video interface in response to the print request from the host.

In accordance with four color (yellow (Y), magenta (M), cyan (C) and black (K)) image data obtained by color-decomposing the image information, color toner images are successively formed by corresponding color toners (developers). The toner images are transferred onto an intermediate transfer body in a superimposed fashion and then are collectively transferred onto a transfer material such as a paper sheet.

A photosensitive drum (first image bearing body) 1 (constituted by coating a photosensitive layer made of organic photosensitive material on an aluminum cylinder having an outer diameter of 100 mm) on which a latent image is to be formed is rotated in a direction shown by the arrow A at a predetermined peripheral speed (80 mm/sec).

First of all, a surface of the photosensitive drum 1 is uniformly charged (to about −600 V) by a charging roller (charging means) 2.

Then, in response to first color (Y) image data, the scanning is effected by a laser scanner (exposure means) 3 which is ON/OFF-controlled, thereby forming a first color electrostatic latent image (having exposed potential of about −100 V).

The first color electrostatic latent image is developed and visualized by first developing means 4*a* containing first color (Y) toner (having negative polarity).

The visualized first toner image is transferred onto an intermediate transfer body (second image bearing body) 5 (urged against the photosensitive drum 1 with a predetermined urging force and rotated in a direction shown by the arrow B at a peripheral speed substantially the same as the peripheral speed (80 mm/sec) of the photosensitive drum 1) at a nip between the photosensitive drum and the intermediate transfer body 5.

The intermediate transfer body 5 is constituted by coating a conductive elastic layer made of NBR rubber or the like on an aluminum cylinder and then by coating a surface layer having a mold releasing ability and made of urethane resin (in which carbon or fluororesin is dispersed) on the elastic layer to have a resistance value of $10^5$ to $10^{10}$ Ωcm and an outer diameter of 153 mm.

Voltage VItr (+100 V) having polarity opposite to charging polarity (negative) of the toner is applied to the intermediate transfer body 5.

Residual toner which was not transferred during the primary-transferring and remained on the photosensitive drum 1 is scraped off by a cleaning blade (cleaning means) 8 urged against the photosensitive drum 1 and the scraped toner is collected into a waste toner container 9.

Regarding the remaining three colors (M, C, K), the above-mentioned process is similarly repeated. In this case, the toner images successively formed by different color toners contained in second developing means 4, third developing means 4*c* and fourth developing means 4*d* (referred to generically as "developing means 4") are successively transferred onto the intermediate transfer body 5 electrostatically in a superimposed fashion to form a full-color image.

The color toner images are collectively transferred (secondary-transferring) onto a transfer material 7 conveyed from a sheet feeding portion, at a nip between the intermediate transfer body 5 and a transfer roller (transfer means) 6 which can be urged against the intermediate transfer body at a predetermined timing and which is rotated at a peripheral speed substantially the same as the peripheral speed of the intermediate body 5.

In this case, voltage Vtr (+1000 V) having polarity opposite to a charging polarity (negative) of the toner is applied to the transfer roller 6.

Thereafter, the transfer material 7 to which the toner images were secondary-transferred is conveyed to fixing means 12, where the four color toner images are permanently fixed to the transfer material 7. Then, the transfer material is discharged out of the printer through a discharge portion to obtain a desired print image.

Residual toner remained on the intermediate transfer body 5 after the secondary-transferring (charging polarity of the residual toner is controlled by a toner charge controlling member 13) is returned to the photosensitive drum 1 and then is scraped off by the cleaning blade 8 and is collected into the waste toner container 9.

The photosensitive drum 1, charging roller 2, cleaning blade 8 and waste toner container 9 are assembled as a single process cartridge (photosensitive drum cartridge 10 as a photosensitive body unit) which is detachably attachable to a main body of the apparatus.

Further, the yellow (Y) developing means 4*a,* magenta (M) developing means 4*b,* cyan (C) developing means 4*c* and black (K) developing means 4*d* are constituted as respective process cartridges (developing cartridges as developing device units) which can be independently exchanged when the service life thereof is expired.

Regarding service lives of the process cartridges, it is selected so that the service life of the photosensitive drum cartridge corresponds to 10000 prints for a standard full-color original, the service lives of the color (Y, M, C) developing cartridges correspond to 5000 prints for a standard original and the service life of the black (K) developing cartridge corresponds to 10000 prints for a standard original.

Next, the toner remaining amount detecting method will be explained.

In the illustrated embodiment, although four developing cartridges are used for the respective developing means 4*a*, 4*b*, 4*c*, 4*d*, since the toner remaining amount detecting processes for the developing cartridges are the same, only one developing cartridge will here be described.

In FIG. 2, the image data from the host computer is developed in an image memory portion 21 of the main body of the apparatus. The image data developed in the image memory portion 21 is sent to a laser driving portion 22 at an image forming timing, with the result that an electrostatic latent image corresponding to the image data is formed on the photosensitive drum 1.

At the same time, the number of dots (to be developed by the toner) of the image data developed in the image memory portion 21 is counted in an image dot counting portion 23.

Here, in the illustrated embodiment, 256 dots included in a rectangular area (16 dots×16 dots) are handled as one process unit, and the image dots in the area are counted, and, for each process unit, the image dot number S is sent to a toner using amount operating (calculating) portion 24.

In the toner using amount operating portion 24, on the basis of a relationship between the image dot number S for a predetermined one process unit and the toner using amount (FIG. 3) and a relationship between a photosensitive drum using amount D and the toner using amount (FIG. 4), the toner using amount G is calculated for every one process unit, and the calculated values are integrated for the entire image, thereby determining the toner using amount integrated value.

In general, in dependence upon a ratio of the image dot number in a given area, the toner using amount per one dot is changed.

The reason is that, since development is effected in an area greater than the actual area due to expansion of a laser spot or a greater amount of toner is used than a solid image at edge portions between image portions and a nonimage portions (edge effect), the developing amounts per one dot differ from each other between a case of a low image dot number where the edge portions between image portions and a nonimage portions are relatively much and a case of high image dot number where the edge portions between image portions and a nonimage portions are relatively little, in a given area (constant area).

Figure 3:
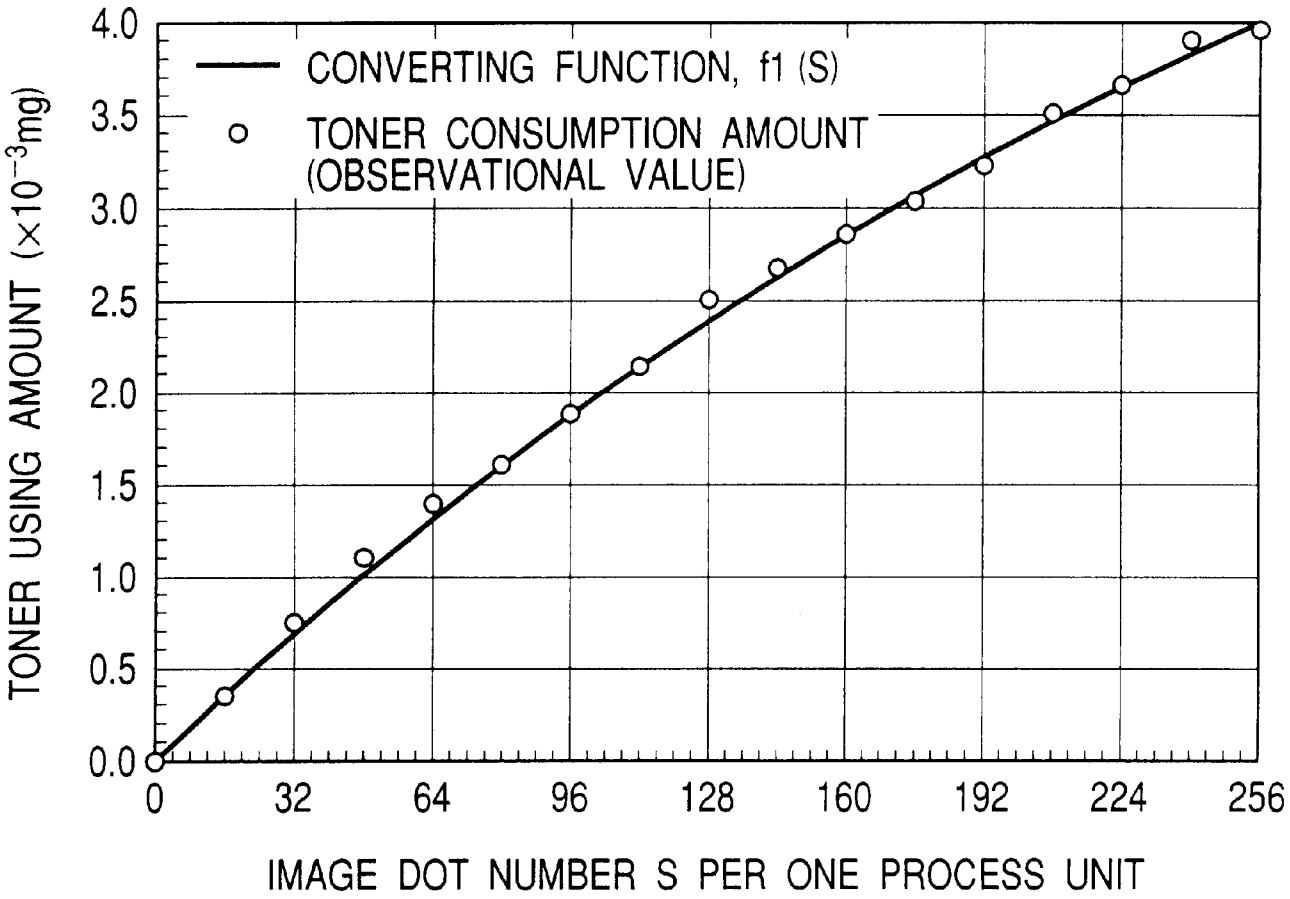
FIG. 3 is a graph showing a relationship between an image dot number and a toner using amount in the first embodiment.

Thus, regarding the image dot number S for one process unit (given area), as shown by the graph in FIG. 3, the toner using amount GO at the initial condition of the photosensitive drum using amount is derived from:

First conversion function $GO=f1(S)$.

Further, regarding the relationship between the photosensitive drum using amount D and the toner using amount, as the photosensitive drum 1 is continuously used, the thickness of the surface layer is decreased to increase the capacitance of the photosensitive layer and to make the surface of the photosensitive drum more rough or to change the surface potential of the photosensitive drum 1 after exposure even when the same exposure amount is applied, with the result that the developing amount on the photosensitive drum 1 or the transferring amount from the photosensitive drum 1 to the transfer material 7 or the intermediate transfer body 5 is changed or the like, thereby changing the developer using amount required for forming the image having same image density in accordance with the photosensitive drum using amount D.

Figure 4:
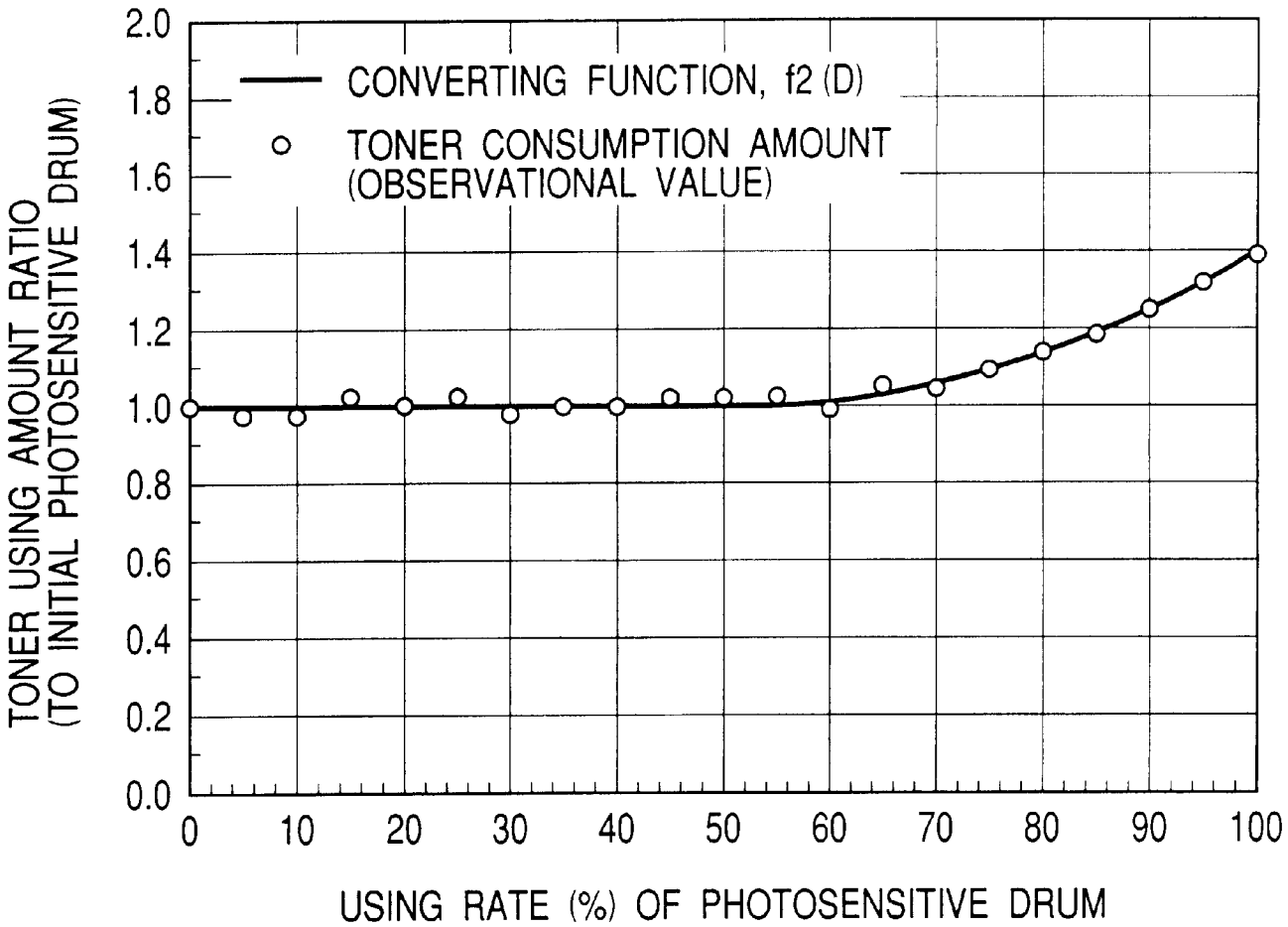
FIG. 4 is a graph showing a relationship between using rate of a photosensitive drum and toner using amount ratio in the first embodiment.

In the photosensitive drum 1 used in the illustrated embodiment, when it is assumed that the service life is regarded as 100% photosensitive drum using amount, such change appears at about 50% using amount, and, when it is assumed that the toner using amount of the given pattern image at the initial using condition of the photosensitive drum is 1, transition (relative ratio) of the toner using amount changing in dependence upon the photosensitive drum using amount D is changed as shown in FIG. 4. It was found that such change has substantially the same transition regardless of the image dot number S for one process unit.

Thus, the toner using amount G for one process unit regarding the photosensitive drum using amount D is given by the following equation on the basis of a second conversion function f2(D) indicating a relative ratio (toner using amount ratio) between the photosensitive drum using ratio derived by using the conversion table of FIG. 4 and the toner using amount in the initial condition:

Toner using amount $G=GO\times f2(D)$.

In FIG. 4, the abscissa indicates the photosensitive drum using amount D as using rate (%) of the photosensitive drum, and the ordinate indicates the toner using amount ratio (to initial photosensitive drum).

Incidentally, data regarding the photosensitive drum using amount D is calculated in a photosensitive drum using amount operating portion 28 by using photosensitive drum rotating time data from a rotation of photosensitive drum instructing portion 26, charging roller bias applying time data from a charging roller bias applying time detecting portion 27 and converting equations utilizing predetermined weighting coefficient and is stored in a photosensitive drum using amount integrating and storing portion 29.

The toner using amount operating portion 24 calculates or operates the toner using amount G for one process unit (operating equation) (G=f1(S)×f2(D)).

Thereafter, for the entire image, a series image dot number counting operations and calculations are repeated to integrate the toner using amount for the entire image. Then, by subtracting the toner using amount integrated value from the remaining amount toner in the developing means stored in the toner remaining amount storing portion 25, a new toner remaining amount is renewed and stored again.

The toner remaining amount storing portion 25 includes a toner initial usable amount storing area, as well as the toner remaining amount storing area, so that, when the fact that the developing cartridge is exchanged to a new one is detected, data in the toner remaining amount storing area is reset and toner initial usable amount data preset in the toner initial usable amount storing area is inputted to the toner remaining amount storing area.

An alarming portion (displaying portion) 30 as displaying means serves to display the newly renewed and stored toner remaining amount and the photosensitive drum using amount D on a displaying portion of the main body of the apparatus and to send such amount data to the host computer and also serves to display an alarming message demanding an exchange of the developing cartridge on the displaying portion of the main body of the apparatus and on the host computer if the toner remaining amount is decreased below a defined value.

Similarly, such process control are also effected regarding the other developing cartridges by using respective calculating equations such as first and second conversion functions.

From endurance tests of photosensitive drum cartridges combined with new and old developing cartridges, it was found that, even when the developing cartridge is exchanged at the rear half of the used condition of the photosensitive drum, the remaining amount of toner in the developing means can be detected with high accuracy, similar to the case where the developing cartridge is exchanged at the front half of the used condition of the photosensitive drum.

As mentioned above, since the remaining amount of toner in the developing means is detected by counting the number of dots of the image formed on the photosensitive drum 1 and by calculating the toner using amount on the basis of the image dot number and the photosensitive drum using amount, even if the service life of the photosensitive drum cartridge differs from the service life of the developing cartridge, regardless of the used condition of the photosensitive drum cartridge, the toner using amount can be grasped correctly and the operator can accurately be informed of the accurate remaining amount of toner in the developing means.

Further, as an alteration, in addition to the arrangement of the illustrated embodiment, as shown in FIG. 5, toner remaining amount storing means (such as memories) 401*a*, 401*b*, 401*c*, 401*d* may be provided on the respective developing cartridges and a toner remaining amount recording and reading portion 31 may be in the main body of the apparatus.

With this arrangement, by sequentially storing the detected toner remaining amounts in the respective toner remaining amount storing means of the developing cartridges, since each developing cartridge stores its toner remaining amount, even if the operator dismounts and remounts the developing cartridge with respect to the main body of the apparatus or dismounts the developing cartridge from the main body of the apparatus and then mounts it to another image forming apparatus, the toner remaining amount detection can similarly be continued with high accuracy, and, if the used-up or expired developing cartridge is inserted, since the alarm can be emitted immediately, the printing with no toner condition can be prevented.

Incidentally, in the illustrated embodiment, the developing cartridge integrally which includes a developing portion such as a developing sleeve and a doctor blade and a toner hopper containing the toner and which can be exchanged is used. However, also in a replenishing type developing cartridge in which the developing portion and the toner hopper can be exchanged independently or in a replenishing type developing cartridge in which the developing portion is secured to the main body of the apparatus and only the toner is replenished, a similar effect can be achieved, for example, by integrating data regarding a toner replenishing amount in the toner remaining amount storing portion 25 during toner replenishment or by resetting the data in the toner remaining amount storing portion during exchange of the toner hopper.

Further, not only in the full-color image forming apparatus but also in a monocolor image forming apparatus, so long as the photosensitive drum unit is formed independently from the developing units, the similar effect can be achieved.

In addition, since one process unit arrangement (dot number, process unit style and the like), first conversion function for the toner using amount GO regarding the image dot number S for one process unit and second conversion function for the toner using amount G for one process unit regarding the photosensitive drum using amount D are varied with various conditions inherent to the image forming apparatus (such as toners, photosensitive drum and developing system), by optimizing such factors appropriately, the similar effect can be achieved.

[Second Embodiment]

Next, a second embodiment of the present invention will be explained with reference to FIGS. 6 and 7.

An image forming apparatus according to a second embodiment is a monocolor laser printer and has a photosensitive drum cartridge (photosensitive body unit) 10 integrally including a photosensitive drum 1, a charging roller 2, a cleaning blade 8 and a waste toner container 9, a developing cartridge (developing device unit) 402, and a toner cartridge 403 for replenishing toner to the developing cartridge. Since the other elements are the same as those in the first embodiment, such elements are designated by the same reference numerals and explanation thereof will be omitted.

Regarding service lives of the cartridges, it is selected so that the service life of the photosensitive drum cartridge corresponds to 20000 prints for a standard original, the service life of the developing cartridge corresponds to 50000 prints for a standard original and the service life of the toner cartridge corresponds to 5000 prints for a standard original.

Although a toner remaining amount detecting method according to the second embodiment is substantially similar to that of the first embodiment, since the using endurance property of the photosensitive drum 1 used differs from that in the first embodiment, in the second embodiment, there is provided a plurality of converting tables for the toner using amount with respect to the photosensitive drum using amount D so that the converting tables can be switched in accordance with the number of dots per one process unit.

In FIG. 6, the image data from the host computer is developed in an image memory portion 21 of the main body of the apparatus. The image data developed in the image memory portion 21 is sent to a laser driving portion 22 at an image forming timing, with the result that an electrostatic latent image corresponding to the image data is formed on the photosensitive drum 1.

At the same time, the number of dots (to be developed by the toner) of the image data developed in the image memory portion 21 is counted in an image dot counting portion 23.

Here, in the illustrated embodiment, 256 dots included in a rectangular area (16 dots×16 dots) are handled as one process unit, and the number of image dots in the area are counted, and, for each process unit, the image dot number S is sent to a toner using amount operating (calculating) portion 24.

In the toner using amount operating portion 24, on the basis of a relationship between the image dot number S for a predetermined one process unit and the toner using amount (similar to the first embodiment in FIG. 3) and a relationship between a photosensitive drum using amount D and the toner using amount (FIG. 7), the toner using amount G is calculated for every one process unit.

Regarding the image dot number S for one process unit, the toner using amount GO at the initial condition of the photosensitive drum using amount is given by the following equation, from the converting table of FIG. 3:

$$GO=f1(S).$$

Further, in the photosensitive drum 1 according to second embodiment, when the thickness of the surface layer is decreased as the photosensitive drum is continuously used, although the surface potential of the photosensitive drum (when solid exposure was effected) is not so changed greatly, since the surface potential in the halftone becomes to be not reduced, the toner using amount will be changed in a relatively thin image (in which the image dot number S per one process unit is small).

Figure 7:
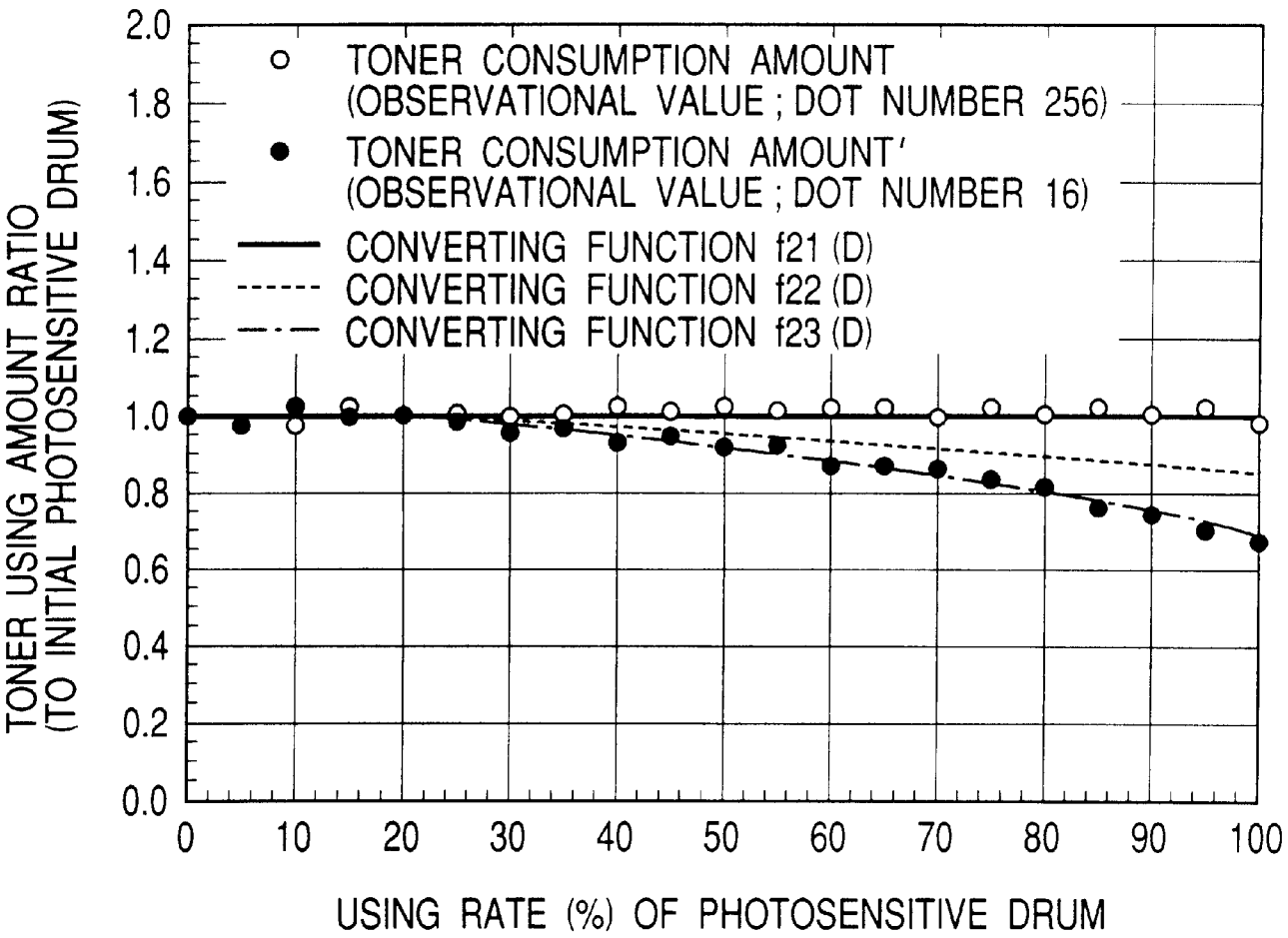
FIG. 7 is a graph showing a relationship between using rate of a photosensitive drum and toner using amount ratio in the second embodiment.

Thus, when it is assumed that the toner using amount at the initial using condition of the photosensitive drum is 1, transition of the photosensitive drum using amount D and the toner using amount regarding the image dot number S per one process unit is changed to follow a plurality of second conversion functions, as shown in FIG. 7. In FIG. 7, the abscissa and the ordinate indicate the similar contents as in FIG. 4.

That is to say, the toner using amount G for one process unit regarding the photosensitive drum using amount D is given by the following equation on the basis of the second conversion functions f21(D), f22(D) and f23(D) on the converting table of FIG. 7:

When image dot number S is 0 to 32:

$$G=GO\times f23(D).$$

When image dot number S is 33 to 64:

$$G=GO\times f22(D).$$

When image dot number S is equal to or more than 65:

$$G=GO\times f21(D).$$

Accordingly, the toner using amount operating portion 24 calculates or operates the toner using amount G for one process unit by using the following operating equations:

When image dot number S is 0 to 32:

$$G=f1(S)\times f23(D).$$

When image dot number S is 33 to 64:

$$G=f1(S)\times f22(D).$$

When image dot number S is equal to or more than 65:

$$G=f1(S)\times f21(D).$$

Thereafter, for the entire image, a series image dot number counting operations and calculations are repeated to integrate the toner using amount for the entire image. Then, by subtracting the toner using amount integrated value from the remaining amount toner in the developing means stored in the toner remaining amount storing portion 25, a new toner remaining amount is renewed and stored again.

The toner remaining amount storing portion 25 includes a toner initial usable amount storing area and a toner replenishing amount storing area, as well as the toner remaining amount storing area.

Thus, when the fact that the developing cartridge exchanged to a new one is detected, data in the toner remaining amount storing area is reset and toner initial usable amount data preset in the toner initial usable amount storing area is inputted to the toner remaining amount storing area.

Further, when the fact that the toner is replenished by the toner cartridge is detected, the toner replenishing amount data preset in the toner replenishing amount storing area is added to the toner remaining amount data in the toner remaining amount storing area.

An alarm portion 30 serves to display the newly renewed and stored toner remaining amount and the photosensitive drum using amount on a displaying portion of the image forming apparatus and to send such amount data to the host computer and also serves to display alarming message demanding toner replenishment by the toner cartridge on the displaying portion of the main body of the apparatus and on the host computer if the toner remaining amount is decreased below a threshold value.

Further, when it is judged that the developing cartridge is used by predetermined times, an alarm message demanding exchange of the developing cartridge is displayed on the displaying portion and on the host computer.

From endurance tests of photosensitive drum cartridges combined with new and old toner replenishing cartridge and developing cartridge under the above-mentioned control, it was found that, even when the toner is replenished at the rear half of the used condition of the photosensitive drum, the calculated toner remaining amount does not differ from that in case where the toner is replenished at the front half of the used condition of the photosensitive drum, thereby detecting the remaining amount of toner in the developing means with high accuracy.

In the illustrated embodiment, as mentioned above, by providing the plurality of converting tables corresponding to the properties of the photosensitive drums 1 and by switching the converting tables in accordance with the parameter (image dot number), as is in the first embodiment, regardless of the used condition of the photosensitive drum cartridge, the toner using amount can be grasped correctly and the operator can accurately be informed of the accurate remaining amount of toner in the developing means.

Incidentally, in the illustrated embodiment, while an example that the second conversion functions regarding the photosensitive drum using amount D and the toner using amount are switched in accordance with the image dot number S per one process unit was explained, in an image forming apparatus in which a plurality of photosensitive drums having different photosensitive layer thickness and sensitivity can be used, it is very effective to discriminate the kind of the photosensitive drum and to switch the first conversion function regarding the photosensitive drum using amount and the toner using amount on the basis of the discriminated kind of photosensitive drum.

Further, in the first and second embodiments, while an example that the calculation is effected by changing the calculating equation using two conversion functions, i.e., first conversion function regarding the image dot number S per one process unit and the toner using amount at the photosensitive drum using amount and the second conversion function regarding the photosensitive drum using amount D and the toner using amount was explained, a plurality of first conversion functions corresponding to the photosensitive drum using amounts D may previously be prepared and the first conversion functions may be successively switched in accordance with the photosensitive drum using amount data to change the calculating equation for calculation, thereby achieving the same effect. In this case, the calculating equation for calculation may merely be changed in accordance with the photosensitive drum using amount D.

According to the illustrated embodiment, by calculating the developer using amount while changing the calculating equation in accordance with the using amount of the image bearing body on which the formed latent image is developed by the developing means, the developer using amount can be grasped correctly and the remaining amount of developer in the developing means can be detected with high accuracy.

By providing the first conversion function for deriving the developer using amount at the initial condition of the image bearing body from the image dot number and the second conversion function for seeking the relative ratio between the developer using amount at the initial condition of the image bearing body and the present developer using amount changed in accordance with the using amount of the image bearing body and by changing the calculating equation by multiplying the developer using amount at the initial condition of the image bearing body derived from by the first conversion function by the relative ratio sought by the second conversion function, the developer using amount can be calculated correctly.

By providing the displaying means for displaying the detected remaining amount of developer in the developing means and for displaying the alarm message if the developer remaining amount is decreased below the predetermined value, the operator can be informed of the developer remaining amount with high accuracy.

What is claimed is:

1. A developer remaining amount detecting apparatus of a developing apparatus for developing an electrostatic image on an image bearing body, said detecting apparatus comprising:

counting means for counting a number of an image data;

integrating means for integrating a use amount on said image bearing body; and operating means for operating a developer remaining amount on the basis of a count value of said counting means and an integrated value of said integrating means.

2. A developer remaining amount detecting apparatus according to claim 1, wherein said operating means multiplies a value obtained from the count value by a coefficient based on the integrated value.

3. A developer remaining amount detecting apparatus according to claim 1, wherein said image bearing body is charged by a charging device on which a charging bias voltage is applied, and said integrating means integrates a value operated by a rotating time of said image bearing body and a charging bias applying time.

4. A developer remaining amount detecting apparatus according to claim 3, wherein said image bearing body and said charging device are constituted as a process cartridge of an integrated unit, and said process cartridge has a memory for storing the integrated value.

5. A developer remaining amount detecting apparatus according to claim 4, wherein said developing apparatus is constituted as a unit separated from a process cartridge, and said developing apparatus is exchanged for a new unit when a life is expired.

6. A developer remaining amount detecting apparatus for a developing apparatus for developing an electrostatic image on an image bearing body, said detecting apparatus comprising:

counting means for counting a number of an image data;

recognizing means for recognizing an integrated use amount of said image bearing body without using the image data; and outputting means for outputting information regarding a developer remaining amount on the basis of a count value of said counting means and the integrated use amount recognized by said recognizing means.

7. A developer remaining amount detecting apparatus according to claim 6, wherein the use amount is determined on the basis of a rotation time of said image bearing body and a voltage applying time in which a voltage is applied to a charging device for charging said image bearing body.

8. A developer remaining amount detecting apparatus according to claim 7, wherein said image bearing body and said charging device are constituted as a process cartridge of an integrated unit, and said process cartridge includes a memory for storing the integrated value.

9. A developer remaining amount detecting apparatus according to claim 8, wherein a developing apparatus is constituted as a unit separated from said process cartridge, and said process is exchanged for an unexpired process cartridge when a useful life of the process cartridge being exchanged has expired.

* * * * *

UNITED STATES PATENT AND TRADEMARK OFFICE

CERTIFICATE OF CORRECTION

PATENT NO. : 6,476,837 B2
DATED : November 5, 2002
INVENTOR(S) : Hiroaki Ogata

It is certified that error appears in the above-identified patent and that said Letters Patent is hereby corrected as shown below:

Column 10,
Line 21, "An akarm portion" should read -- An alarming portion --.

Column 12,
Line 48, "said process" should read -- said process cartride --.

Signed and Sealed this

Twenty-second Day of April, 2003

JAMES E. ROGAN
*Director of the United States Patent and Trademark Office*